US006208825B1

(12) United States Patent
Hays

(10) Patent No.: US 6,208,825 B1
(45) Date of Patent: Mar. 27, 2001

(54) LOW-FRICTION SINGLE COMPONENT DEVELOPMENT APPARATUS

(75) Inventor: Dan A. Hays, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/465,850

(22) Filed: Dec. 17, 1999

(51) Int. Cl.[7] ..... G03G 15/08

(52) U.S. Cl. ..... 399/266; 399/281; 399/285; 399/286

(58) Field of Search ..... 399/266, 265, 399/279, 281, 285, 286; 430/120

(56) References Cited

U.S. PATENT DOCUMENTS

| | | | | |
|---|---|---|---|---|
| 5,010,367 | * | 4/1991 | Hays | 355/247 |
| 5,172,170 | * | 12/1992 | Hays et al. | 355/259 |
| 5,339,142 | * | 8/1994 | Hays | 355/259 |
| 5,512,981 | * | 4/1996 | Hirsch | 355/208 |
| 5,541,716 | * | 7/1996 | Schmidlin | 355/261 |
| 5,734,954 | * | 3/1998 | Eklund et al. | 399/266 |
| 5,734,955 | * | 3/1998 | Gruber | 399/266 |

FOREIGN PATENT DOCUMENTS

0415700 * 6/1991 (EP) .

* cited by examiner

*Primary Examiner*—Richard Moses
(74) *Attorney, Agent, or Firm*—Tallam I. Nguti

(57) ABSTRACT

A low-friction single component development apparatus for developing electrostatic latent images on an image bearing surface is provided. It includes a sump containing a supply of developer material particles; a moveable donor member assembly including a donor member for transporting developer material particles through a development zone; a first combination of AC and DC biases for charging developer material particles in the sump resulting in charged developer material particles having a desired polarity and charge distribution; a second combination of AC and DC biases for providing fringe electric fields for depositing particles of the charged developer material particles onto the donor member; devices for forming a developer material cloud within the development zone for image development; and an electrostatic filtering zone located upstream of the development zone for electrostatically removing wrong-sign charged developer material particles from the donor member.

11 Claims, 3 Drawing Sheets

LOW-FRICTION SINGLE COMPONENT DEVELOPMENT APPARATUS

BACKGROUND OF THE INVENTION

This invention relates generally to electrostatographic reproduction machines, and more particularly to a non-interactive, low-friction single component developer material development apparatus that enables use of fragile and easily fused toners without toner degradation. The present invention can be utilized in the art of xerography or in the printing arts.

The art or process of xerography involves forming electrostatic latent images on a surface by first uniformly charging a photoreceptor. The photoreceptor comprises a charge retentive surface. The charge is image-wise selectively dissipated in accordance with an image pattern of activating radiation corresponding to an original image. The selective dissipation of the charge leaves a latent charge pattern on the imaging surface corresponding to the areas not exposed by radiation.

This charge pattern is then developed, or made visible with a development apparatus or unit containing developer material such as single component, or toner and other components including carrier particles. The toner is generally a colored powder which is charged and adheres to the charge pattern by electrostatic attraction resulting in a toner developed image. The toner developed image is then fixed to the imaging surface or is transferred to a receiving substrate such as plain paper to which it is thereafter fixed by suitable fusing techniques.

Black and white toner images can be formed by the process as described above, and multicolor toner images can be similarly formed by using not just one but several development units containing different colors of toner. Such multicolor toner images can be highlight color images or full color images. One approach for forming such toner images is in a single pass of the photoreceptor during which color separation toner images are formed in registration, one on another, or in what is called an "image-on-image" manner.

The viability of image-on-image reproduction machines, such as those for producing highlight color or image-on-image full color images, requires development units that are non-interactive, i.e. developments units that do not scavenge or interact with a previously toned image on the photoreceptor. Although development units and techniques have been proposed for achieving non-interactive or scavengeless development, developer material degradation or the need to use hard-to-fuse toner continue to present problems with most such development units.

This is so because on the one hand, in order to enable efficient electrostatic transfer of xerographic toner images from a photoreceptor to plain paper, the toner should be insulating so as to prevent charge reversal at the toner-paper interface. The method commonly used for charging such insulating toner involves the phenomenon of triboelectricity which requires high-frictional contacts between the toner and other materials such as carrier beads in two-component developer systems, or metering blades, rods and donor rolls, in single component developer systems. On the other hand however, such required high frictional contacts tend to cause undesirable premature developer material or toner degradation.

It has been found that in order to prevent such undesirable material degradation so as to achieve and maintain stable system performance, mechanical stresses involved in the toner triboelectric charging process as above, must not exceed the toner yield stress. Additionally, from a toner fusing standpoint, toners that flow well under the application of heat and/or pressure are of course preferred. This is particularly desired for color imaging where low-melt toners are preferred. For these reasons, toners that tend to be fragile are strongly preferred. Unfortunately, they cannot withstand the high frictional contacts required by triboelectric charging, and there is therefore a need for low-friction single component development systems that are gentle on such toners.

SUMMARY OF THE INVENTION

In accordance with the present invention, there is provided a low-friction single component development apparatus for developing electrostatic latent images on an image bearing surface. The low-friction single component development apparatus includes a sump containing a supply of developer material particles; a moveable donor member assembly including a donor member for transporting developer material particles through a development zone; a first combination of AC and DC biases for charging developer material particles in the sump resulting in charged developer material particles having a desired polarity and charge distribution; a second combination of AC and DC biases for providing fringe electric fields for depositing particles of the charged developer material particles onto the donor member; devices for forming a developer material cloud within the development zone for image development; and an electrostatic filtering zone located upstream of the development zone for electrostatically removing wrong-sign charged developer material particles from the donor member.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
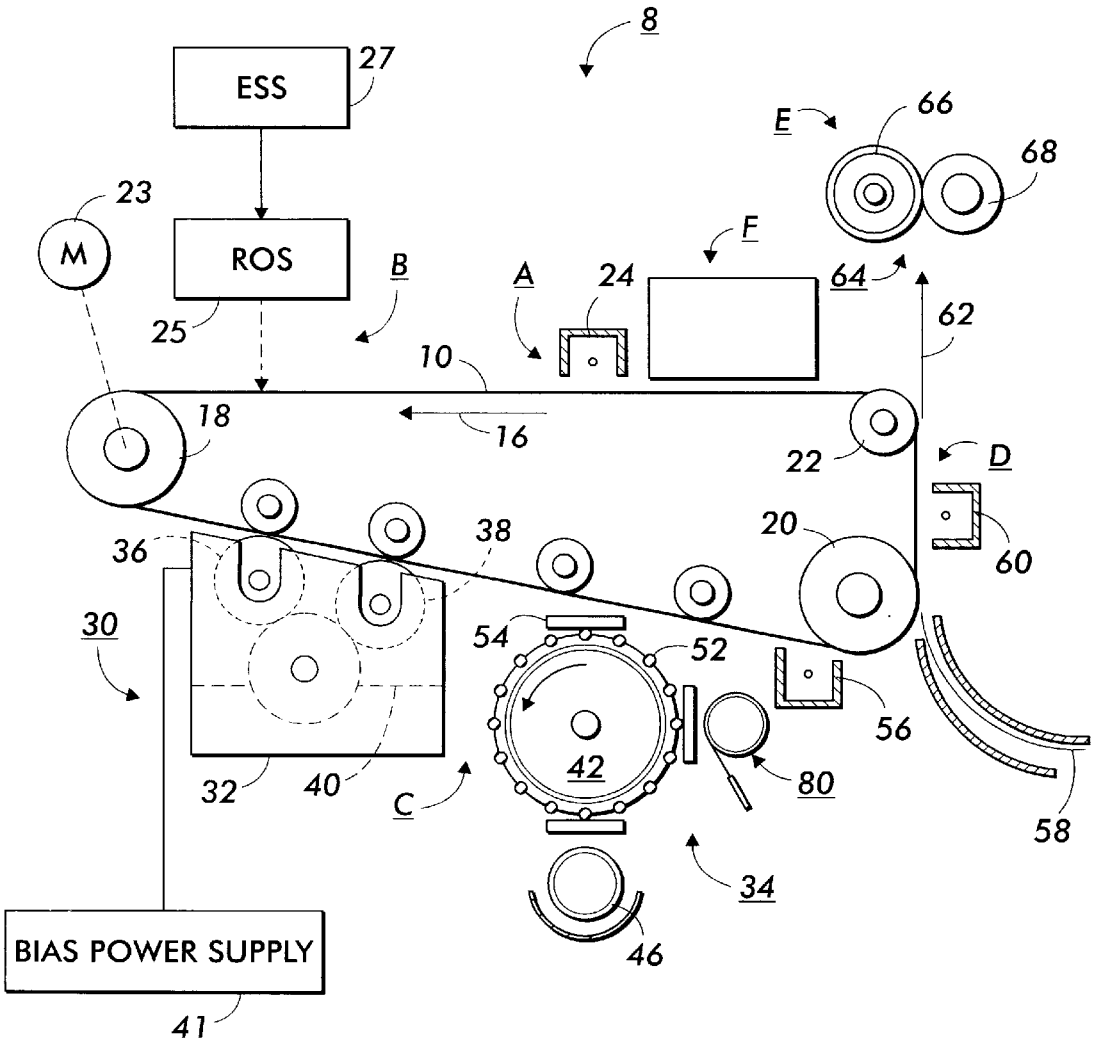
FIG. 1 is a schematic illustration of an electrostatographic reproduction machine incorporating the low-friction single component development apparatus of the present invention.

Referring now to FIG. 1, there is illustrated an electrostatographic reproduction machine, for example, a highlight color reproduction machine 8 in which the low-friction single component development apparatus of the present invention (to be described in detail below) may be utilized. It is understood that the development apparatus of the present invention can be used equally in an image-on-image full color reproduction machine.

In highlight color xerography as taught by Gundlach in U.S. Pat. No. 4,078,929, the xerographic contrast on the charge retentive surface or photoreceptor is divided into three levels, rather than two levels as is the case in conventional xerography. The photoreceptor is charged, typically to a full potential, e.g. 900 volts. It is first exposed image-wise, such that one image corresponding to charged image areas (which are subsequently developed by charged-area development, i.e. CAD) stays at the full potential. The other image is exposed to form a second or highlight image by discharging the photoreceptor to a residual potential, (typically about 100 volts). The second exposure provides discharged area images (that are subsequently developed by discharged-area development, i.e. DAD). To form the background areas, the photoreceptor exposure in the background areas is such as to result in a potential that is halfway, (typically 500 volts), between the full potential of CAD areas and the residual potential of DAD areas.

As illustrated, the highlight color reproduction machine 8 comprises a charge retentive member in the form of a photoconductive belt 10 consisting of a photoconductive surface and an electrically conductive substrate 43. The photoconductive belt 10 is mounted for movement past a series of processing stations including a charging station A, an exposure station B, a developer station C, a transfer station D, and a cleaning station F.

As shown, belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. A motor 23 rotates roller 18 to advance belt 10 in the direction of arrow 16. Roller 18 is coupled to motor 23 by suitable means such as a belt drive.

By further reference to FIG. 1, initially as successive portions of photoreceptor surface of belt 10 pass through charging station A, a corona discharge device such as a scorotron, corotron or dicorotron indicated generally by the reference numeral 24, charges portions of the charge retentive surface of the belt 10 passing under the device 24 to a selectively high and uniform positive or negative full potential. Any suitable control, well known in the art, may be employed for controlling the corona discharge device 24.

Next, the charged portions of the charge retentive surface of the photoreceptor of belt 10 are advanced through exposure station B. At exposure station B, each uniformly charged portion is image-wise exposed, for example, by a laser based input and/or output scanning device 25, that is controlled by an electronic subsystem (ESS) controller 27, and that causes the charge retentive surface to be discharged in accordance with the image data output from the scanning device 25. Preferably the scanning device 25 is a three level laser Raster Output Scanner (ROS) for differentially discharging the fully charged surface so as to result in fully charged CAD image areas, discharged DAD image areas and discharged background areas.

The three level laser Raster Output Scanner (ROS) device 25 does so under the control of the electronic subsystem (ESS) controller 27 which also provides control for other subassemblies of the machine 8. When the photoreceptor which is charged to a desired initial full voltage or potential is exposed at the exposure station B, it is discharged to a voltage or potential that is near zero or ground potential in the highlight (i.e. color other than black) color parts of the image (DAD image areas). The photoreceptor is also halfway discharged image-wise in the background (white) image areas, leaving other areas at the full potential, (CAD image areas). The result is a tri-level electrostatic latent image comprised of two types of image areas, i.e. CAD image areas and DAD image areas, and of background areas.

At development station C, a first development apparatus, indicated generally by the reference numeral 30 advances developer materials into contact with the DAD image areas of the electrostatic latent image. As shown, the development station C includes the first development apparatus 30 and second developer or development apparatus comprising the low-friction single component development apparatus 34 of the present invention. As shown, the first development apparatus 30 comprises a housing 32 containing a pair of magnetic brush rollers 36 and 38. The rollers 36, 38 advance developer material 40 into contact with the latent image on the charge retentive surface for developing the DAD image areas which are at the residual voltage or potential.

The developer material 40 in the first development apparatus 30, by way of example, preferably is two-component, and thus contains color toner particles and magnetic carrier beads. A DC bias of an appropriate value is applied to the rollers 36 and 38 via the power supply 41. With the foregoing applied bias voltage, and with the color toner suitably charged, discharged area development (DAD) of DAD image areas with colored toner is effected.

Figure 2:
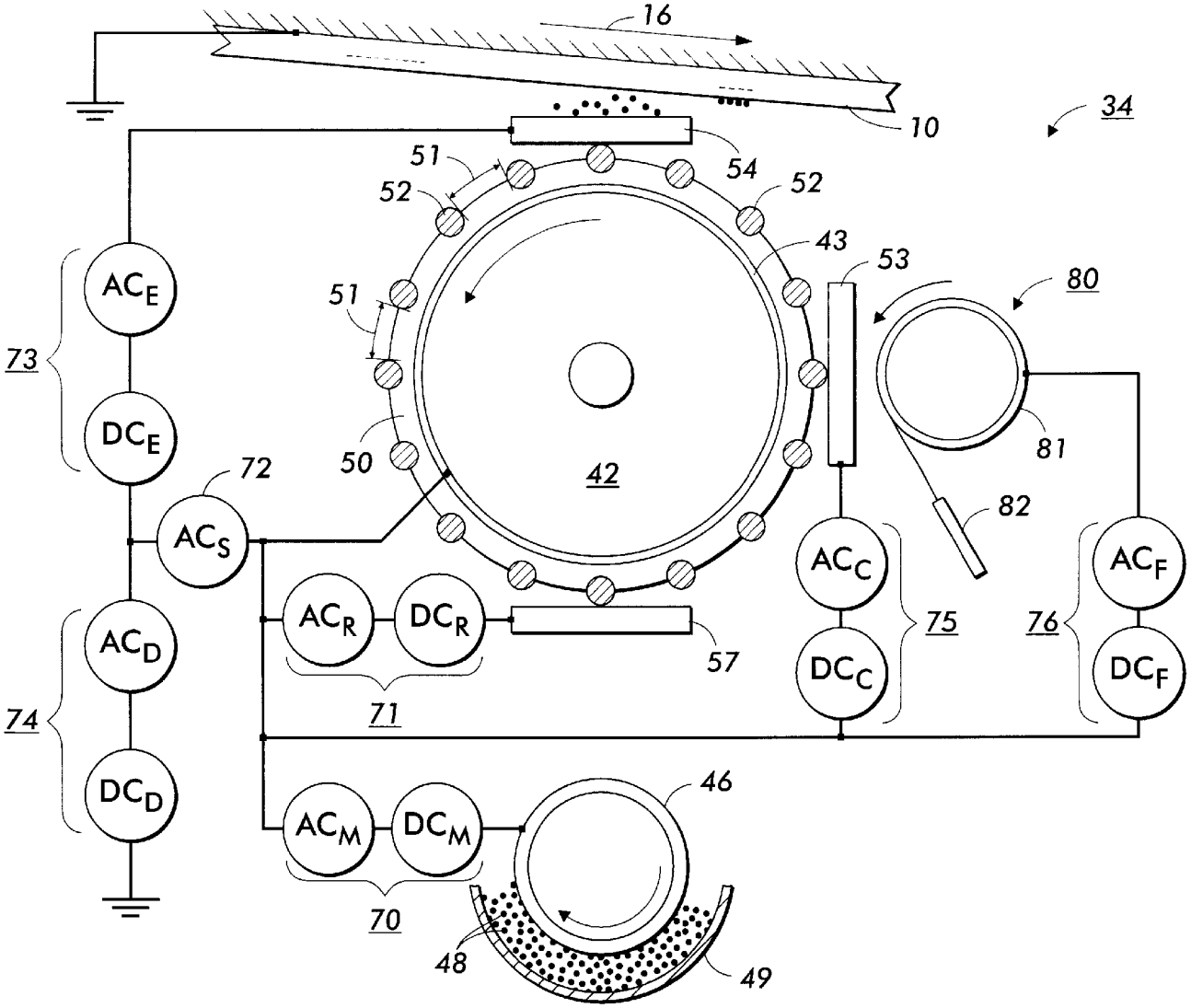
FIG. 2 is an illustration of a first embodiment of the low-friction single component development apparatus of the present invention.

Referring now to FIG. 2, a first embodiment of the low-friction single component development apparatus 34 is illustrated and contains only toner particles 48 as developer material within a sump 49 defined by a housing as shown. The toner particles 48 are low or no friction charged toner particles that are supplied from the toner sump 49 by a toner stirrer 46, onto a charge-relaxable dielectric coating 50 of a donor member, such as a donor roll 42.

Figure 3:
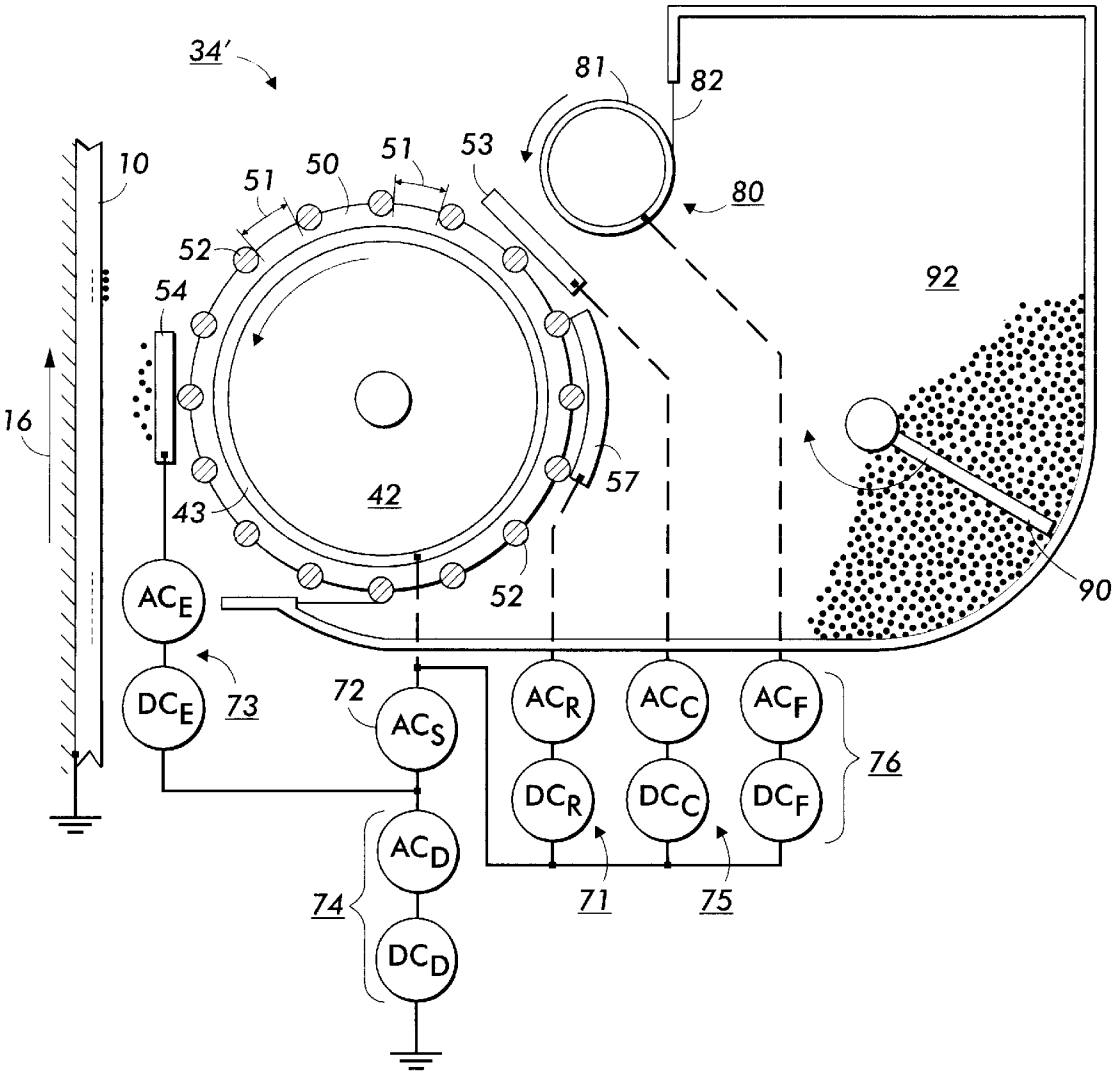
FIG. 3 is an illustration of a second embodiment of the low-friction single component development apparatus of the present invention.

FIG. 3 illustrates a second embodiment of the low-friction single component development apparatus of the present invention shown as 34'. In this second embodiment, instead of the low friction charging toner mover, gravity and a toner mover 90 are used to feed toner gravitationally from a sump 92 to a donor assembly comprising a donor member shown as a donor roll 42. Importantly the second embodiment, apparatus 34', does not include toner stirrer such as 46, or its attendant biases to cause broadening of the toner charge distribution. Besides this difference and the gravitational feeding, the rest of the elements of the first and second embodiments are the same and will be described as such, except where indicated.

Thus as shown, the low-friction single component development apparatus 34, 34' also includes isolated electrodes 52 that protrude above the charge-relaxable dielectric coating 50. The dielectric coating 50 is sufficiently insulating so as to provide electrical isolation between the AC/DC biases applied to the electrodes 52 and the conductive substrate 43 of the donor roll 42. On the other hand, the dielectric coating 50 is also sufficiently insulating so as to relax any charge accumulation on the surface thereof over extended periods of operation. As illustrated, the isolated electrodes 52 protrude above the charge-relaxable dielectric coating 50, and are spaced apart from one another defining spaces 51 therebetween. The biases to the isolated electrode 52 are provided by a commutator 57 at one or both ends of the donor roll 42 in the toner loading zone.

In accordance with the first embodiment, 34, of the present invention, the toner particles 48 are charged in a low or no friction manner to a desired polarity, and to a suitable charge distribution, through the action of a first combination 70 of AC/DC biases ($AC_M$ and $DC_M$) that is coupled to the toner stirrer 46 for depositing the charged toner particles onto the donor roll 42. A second combination 71 of AC/DC biases ($AC_R$ and $DC_R$) functions to provide fringe electric fields that cause the deposition of the toner particles 48 into the spaces 51. Note that in the second embodiment, apparatus 34', there is no toner stirrer such as 46, or its attendant biases.

Ordinarily, the toner stirrer 46 of the first embodiment, 34, usually causes the charge distribution of the toner particles 48 in the sump 49 to be broadly distributed about an average of zero (through triboelectric interactions). Therefore, in order to produce the desired polarity and a desired charge distribution for the toner particles 48 that are transferred to, and fill, the spaces 51 between the protruding electrodes 52, it is important to provide the first and second combinations 70 and 71 of AC/DC biases, ($AC_M$ and $DC_M$) and ($AC_R$ and $DC_R$), on the toner stirrer 46, and on the isolated protruding electrodes 52, respectively.

As shown, in both embodiments, a third combination 73 of AC/DC biases ($AC_E$ and $DC_E$) is provided in the development zone for generating or creating a toner cloud for low-noise, scavengeless development of latent electrostatic images on the photoreceptor. In the development zone, the AC bias ($AC_E$) of the AC/DC combination 73 functions to generate a toner cloud for latent image development. An optimum value for the DC bias ($DC_E$) of the combination is preferably near zero so that toner can be easily released from the spaces 51. The biases to the isolated electrodes 52 within the development zone are provided by a commutator 54 at one or both ends of the donor roll 42.

Additionally, the conductive substrate 43 of the electroded donor roll 42 is electrically biased by an AC bias 72 ($AC_S$) and by a fourth AC/DC combination 74 ($AC_D$ and $DC_D$). The $DC_D$ bias of the combination 74 operates to establish the DC electric field between the electroded donor roll 42 and the image bearing member or photoreceptor 10 for the purpose of suppressing background toner deposition. The $AC_E$ bias of the combination 74 generates the toner cloud for development. The $AC_S$ bias 72 creates an AC electric field between the isolated electrodes 52 and the donor roll 42, while the $AC_D$ bias of the combination 74 creates an AC electric field between the electroded donor roll 42 and the image bearing member or photoreceptor 10.

For a particular toner and gap setting between the donor roll 42 and photoreceptor 10, the amplitude and frequency of the AC bias $AC_D$ can be selected so as to position the toner cloud in close proximity to the photoreceptor 10 in order to enable desired scavengeless or non-interactive development for single-pass color systems, as well as for the effective development of electrostatic images consisting of fine lines and dots.

Additionally, the $AC_S$ bias 72 creates a voltage difference between the isolated electrodes 52 and the conductive substrate 43 of the donor roll 42. This assures the continued effective formation of a toner cloud under conditions where the characteristics of the AC voltage between the donor roll 42 and photoreceptor 10 can vary. For example, a toner cloud can be formed effectively with $AC_E$=500 volts peak and $AC_S$=0 volts. This can also be achieved with $AC_E$=0 volts and $AC_S$=500 volts peak. In both cases, the difference in the AC voltage between the isolated electrodes 52 and the donor roll 42 is 500 volts peak, but the nature of the AC voltage between the donor roll 42 and the image bearing member or photoreceptor 10, is different. As discussed, the AC voltage between the donor roll and image bearing member also depends on $AC_D$.

Importantly in accordance with the present invention, an electrostatic filtering zone 80 is provided for advantageously improving and maintaining the desired toner polarity and charge distribution on the donor roll 42. As shown, the electrostatic filtering zone 80 is mounted upstream of the development zone, relative to rotation of the donor roll 42, and includes a rotating member 81 that is closely spaced from the toned surface of the donor roll 42, and from the isolated protruding electrodes 52.

By applying a suitable combination (a fifth combination) 75 of AC/DC biases ($AC_C$ and $DC_C$) to the isolated electrodes 52, as well as a sixth combination 76 of AC/DC biases ($AC_F$ and $DC_F$) to the rotating member 81, through a commutator 53 (at one or both ends of the donor roll 42), the toner layer is electrostatically filtered by removing wrong-sign toner from the donor roll 42. Wrong-sign toner collected on the biased rotating member 81 is subsequently removed by a doctor or scraper blade 82. Such scraper blade removal of wrong-sign toner from the rotating member 81 results in toner having an average charge of zero since there is air breakdown as the toner collects at the edge of the blade.

When toner remaining on the donor roll 42 after going through the development zone is returned to the sump 49, an additional combination of AC/DC biases (not shown) can be applied to the isolated electrodes 52 for removing such toner from the spaces 51 before such spaces are again reloaded with new toner. Such removal of the spent toner from the spaces advantageously prevents history effects, e.g. ghosting, which is a common problem in the management of toner layers on toner rolls.

As can be seen, there has been provided a low-friction single component development apparatus for developing electrostatic latent images on an image bearing surface is provided. It includes a sump containing a supply of developer material particles; a moveable donor member assembly including a donor member for transporting developer material particles through a development zone; a first combination of AC and DC biases for charging developer material particles in the sump resulting in charged developer material particles having a desired polarity and charge distribution; a second combination of AC and DC biases for providing fringe electric fields for depositing particles of the charged developer material particles onto the donor member; devices for forming a developer material cloud within the development zone for image development; and an electrostatic filtering zone located downstream of the development zone for electrostatically removing wrong-sign charged developer material particles from the donor member.

While the embodiments of the present invention disclosed herein are preferred, it will be appreciated from this teaching that various alternative, modifications, variations or improvements therein may be made by those skilled in the art, which are intended to be encompassed by the following claims:

What is being claimed is:

1. A low-friction single component development apparatus for developing electrostatic latent images on an image bearing surface, the low-friction single component development apparatus comprising:

(a) a sump containing a supply of developer material particles;

(b) a moveable donor member assembly including a donor member for transporting developer material particles from said sump through a development zone adjacent the image bearing surface, said donor assembly including a series of isolated electrodes protruding above said donor member;

(c) a first combination of AC and DC biases for charging said supply of developer material particles in said sump resulting in charged developer material particles having a desired polarity and charge distribution;

(d) a second combination of AC and DC biases for providing fringe electric fields for depositing particles of said charged developer material particles onto said donor member;

(e) means for forming a cloud of said charged developer material particles on said donor member, within the development zone, for image development; and (f) an electrostatic filtering zone located upstream of the development zone relative to movement of said moveable donor assembly for electrostatically removing wrong-sign charged developer material particles from said donor member, thereby controlling and maintaining said desired polarity and charge distribution of said developer material particles within said sump.

2. The low-friction single component development apparatus of claim 1, wherein said supply of developer material comprises toner particles only.

3. The low-friction single component development apparatus of claim 1, wherein said donor member comprises a rotatable donor roll.

4. The low-friction single component development apparatus of claim 1, wherein said donor member includes a charge-relaxable dielectric coating.

5. The low-friction single component development apparatus of claim 1, wherein said means for forming a cloud of said charged developer material particles includes an AC bias, and a DC bias having a value near zero for enabling easily removal of said charged developer material particles from said donor member.

6. The low-friction single component development apparatus of claim 1, wherein said donor member includes a conductive substrate 43 and an AC bias for assuring continued effective formation of said developer material cloud under conditions where characteristics of an AC voltage between said donor member and the image bearing member vary.

7. The low-friction single component development apparatus of claim 1, wherein said electrostatic filtering zone includes a commutator and at least one combination of AC and DC biases applied through said commutator to said donor assembly.

8. The low-friction single component development apparatus of claim 1, wherein said filtering zone includes a rotatable member closely spaced from said donor assembly and an AC/DC bias coupled to said rotatable member.

9. The low-friction single component development apparatus of claim 4, wherein said charge-relaxable dielectric coating is sufficiently insulating for providing relaxing any charge accumulation on a surface thereof over extended periods of operation.

10. The low-friction single component development apparatus of claim 7, wherein said electrostatic filtering zone includes a commutator and two combinations of AC and DC biases, one applied through said commutator to said donor assembly, and the other applied to a rotatable member closely spaced from said donor assembly.

11. A color electrostatographic reproduction machine for producing color toner images without image scavenging defects, the color electrostatographic reproduction machine comprising:

(a) a moveable image bearing member having an image bearing surface;

(b) means including charging and exposure means for forming latent images electrostatically on said image bearing surface; and (c) low-friction single component development apparatus forming a development zone with said image bearing surface for developing electrostatic latent images on said image bearing surface without image scavenging defects, the low-friction single component development apparatus comprising:

(i) a sump containing a supply of developer material particles;

(ii) a moveable donor member assembly including a donor member for transporting developer material particles from said sump through a development zone adjacent said image bearing surface, said donor assembly includes a series of isolated electrodes protruding above said donor member;

(iii) a first combination of AC and DC biases for charging said supply of developer material particles in said sump resulting in charged developer material particles having a desired polarity and charge distribution;

(iv) a second combination of AC and DC biases for providing fringe electric fields for depositing particles of said charged developer material particles onto said donor member;

(vi) means for forming a cloud of said charged developer material particles on said donor member, within said development zone, for latent image development; and (vi) an electrostatic filtering zone located upstream of said development zone relative to movement of said moveable donor assembly for electrostatically removing wrong-sign charged developer material particles from said donor member, thereby controlling and maintaining said desired polarity and charge distribution of said developer material particles within said sump.

* * * * *